United States Patent [19]

Fischer

[11] Patent Number: 4,965,890

[45] Date of Patent: Oct. 30, 1990

[54] SPRING HINGE ASSEMBLY FOR TOILET SEATS

[76] Inventor: Morgan F. Fischer, 76 Main St., Roslyn, N.Y. 11576

[21] Appl. No.: 361,236

[22] Filed: Jun. 5, 1989

[51] Int. Cl.[5] ..... A47K 13/12
[52] U.S. Cl. ..... 4/240; 16/308
[58] Field of Search ..... 16/306, 307, 308, DIG. 36; 4/236, 240, 241, 234, 237

[56] References Cited

U.S. PATENT DOCUMENTS

| | | | |
|---|---|---|---|
| 222,778 | 12/1879 | Fredricks | 16/306 |
| 1,045,927 | 12/1912 | Zeleny et al. . | |
| 1,529,656 | 3/1925 | Kornhauser . | |
| 1,715,590 | 2/1928 | Burhenne | 16/307 |
| 2,814,049 | 11/1957 | Mercur . | |
| 3,414,911 | 12/1968 | Enlow | 4/241 |
| 3,653,077 | 4/1972 | Warnberg . | |
| 4,195,372 | 4/1980 | Farina . | |
| 4,402,092 | 9/1983 | Smallwood . | |
| 4,438,535 | 3/1984 | Paredes . | |
| 4,489,447 | 12/1984 | Umehara . | |
| 4,524,438 | 6/1985 | Einhaus | 16/308 |
| 4,807,307 | 3/1989 | Sato et al. . | |
| 4,817,242 | 4/1989 | Rapp . | |

FOREIGN PATENT DOCUMENTS

| | | | |
|---|---|---|---|
| 1401166 | 4/1965 | France | 16/307 |
| 0006485 | 2/1910 | United Kingdom | 16/307 |

OTHER PUBLICATIONS

*Sperzel Industries Catalolgue* "Industrial Seats" Olson Seats Catalogue.
Olsonite Extra Heavy Industrial Seats Catalogue
Church Commercial Seats Catalogue.
*Your Guide to "Spring-Ology"* by Ajax Springs.

*Primary Examiner*—Richard K. Seidel
*Assistant Examiner*—James Miner
*Attorney, Agent, or Firm*—Dilworth & Barrese

[57] ABSTRACT

A spring toilet seat hinge comprising a spring having a leg for pushing a toilet seat from a lowered to a raised position, a helical torsion coil portion, and a linear bracing shank portion. The spring is mounted within the notch of a seat mounting portion, the notch having a round section for receiving the helical torsion coil, and a linear section extending tangentially from the round section, the linear section containing a bracing wall as backstop for the linear shank of the spring. The spring toilet seat hinge also comprises a hinge pin disposed coaxially within the torsion coil section of the spring and mounted to the seat mounting member, and a mounting bolt depending from the bottom of said seat mounting member.

36 Claims, 5 Drawing Sheets

SPRING HINGE ASSEMBLY FOR TOILET SEATS

BACKGROUND OF THE INVENTION

1. Field of the Invention:

This invention relates to toilet seat hinges, and more particularly to spring hinges for maintaining toilet seats in an upright position.

2. Background of the Prior Art:

Devices to maintain a toilet seat in an upright position are known in the art. Generally, such devices comprise a hinge containing a spring mechanism to bias the toilet seat upward. For example, Warnberg (U.S. Pat. No. 3,653,077) discloses a hinge arrangement for mounting toilet seats and lids which extends laterally between the rear support arms of a toilet seat. The spring hooks under the connecting arms of the seat and exerts a bias which maintains the toilet seat in an upright position. Mercur (U.S. Pat. No. 2,814,049) discloses a spring attachment for toilet seats in which a helical spring has an end which extends underneath a toilet seat to bias it upward.

Typically, the spring hinges of the prior art are complicated arrangements of parts and are specifically fitted to a particular type or size of toilet seat, and they are not adaptable for use on any type of seat other than the type with which they are initially installed. In other words, spring hinges of the prior art cannot be retrofitted onto other various types of seats. Furthermore, the complexity of the prior art devices makes them relatively difficult and costly to manufacture. It would be useful and highly desirable therefore to have a simple, easily manufactured spring hinge which could be fitted not only with new toilet seats, but also retrofitted onto existing toilet seats.

SUMMARY OF THE INVENTION

Accordingly, one object of the present invention is to provide a hinge assembly for toilet seats.

Another object of the present invention is to provide a hinge means for biasing the toilet seat from a lowered position to an upraised or vertical position.

Yet another object of the present invention is to provide a spring hinge assembly which can be easily retrofitted onto a variety of existing toilet seats.

A further object of the present invention is to provide a spring hinge assembly for a toilet seat which is both simple in construction and relatively easy to manufacture.

These and further objects and advantages are achieved herein by providing a hinge assembly for a toilet seat, said hinge assembly comprising:

(a) a spring of integral, single piece construction, said spring comprising a helical torsion coil portion, a linear seat-raising leg portion extending tangentially from said helical torsion coil portion, and a linear bracing means portion extending tangentially from said helical torsion coil portion;

(b) a seat mounting member comprising (i) a notch comprising a substantially round portion for receiving said helical torsion coil portion of said spring, and a linear portion extending tangentially from said round portion for receiving said linear bracing means portion of said spring and for providing a backstop for said linear bracing means portion;

(ii) means for retaining a horizontally extending hinge pin, said means for retaining being located concentrically within said round portion of said notch; and, (iii) means for mounting said seat mounting member to a toilet bowl; and (c) a hinge pin for pivotally connecting a toilet seat to said seat mounting member, said hinge pin being coaxially receivable through said helical torsion coil, and said hinge pin having a first end for being retained in said seat mounting member and a second end for being retained in said toilet seat.

Other objects and advantages are achieved by providing a hinge assembly for a toilet seat, said hinge assembly comprising:

(a) a spring of integral, single piece construction, said spring comprising a torsion coil portion, a linear seat-raising leg portion extending tangentially from said helical torsion coil portion, and a linear bracing means portion extending tangentially from said helical torsion coil portion;

(b) a seat mounting member comprising (i) a notch comprising a substantially round portion for receiving said helical torsion coil portion of said spring, and a linear portion extending tangentially from said round portion for receiving said linear bracing means portion of said spring and for providing a backstop for said linear bracing means portion;

(ii) a hinge post contained in the seat mounting member, said hinge post having a hinge pin portion extending substantially horizontally from said seat mounting member for disposition through said torsion coil and for pivotal connection to a toilet seat, and a mounting bolt portion extending substantially vertically from the base of the seat mounting member for mounting said seat mounting member to a toilet bowl.

Still more objects and advantages are achieved herein by providing the above-identified hinge assemblies in combination with a toilet seat and in combination with a toilet seat pivotally mounted on a toilet bowl.

BRIEF DESCRIPTION OF THE DRAWINGS

FIG. 1C illustrates an alternative embodiment with hinge pin permanently mounted in the seat mounting member;

DETAILED DESCRIPTION OF THE INVENTION

Figure 1:
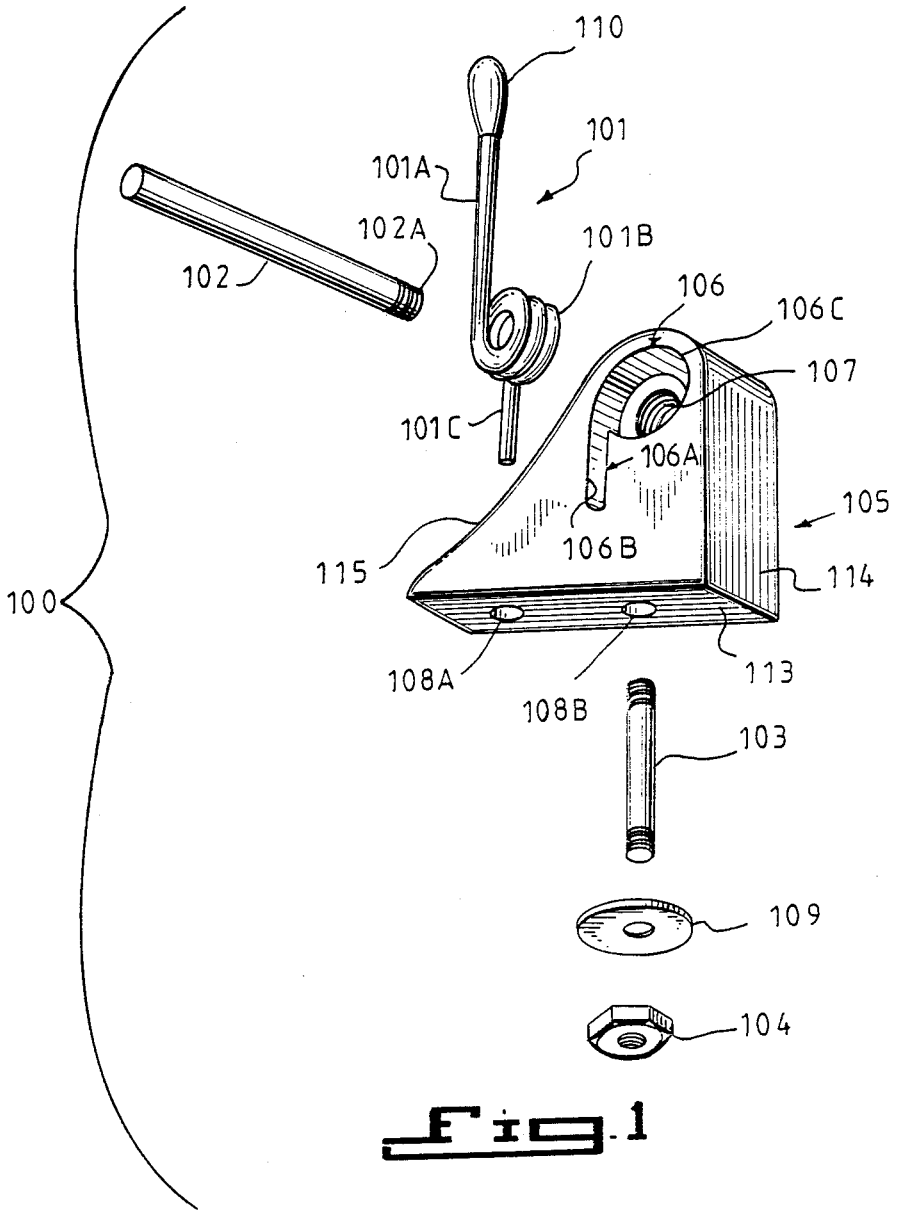
FIG. 1 illustrates an exploded perspective view of the invention.

Referring initially to FIGS. 1 and IA of the drawings, the spring hinge assembly 100 of the present invention comprises a body portion 105, a spring 101, a hinge pin 102, and a mounting bolt 103.

Spring 101 is an integrally constructed single metal piece, and it has three functioning portions: leg 101A, torsion coil 101B, and bracing shank 101C. The helical torsion coil 101B provides a means for storing and releasing torque energy in order to raise the seat from a lowered to an upright position. Leg portion 101A of spring 101 is a relatively long, linear section of metal which, when the hinge assembly 100 is installed, extends beneath the rear of the toilet seat and contacts the underside of the seat, urging the seat in the upward position. The seat-contacting leg 101A extends tangentially from one end of the helical torsion coil portion 101B. Spring 101 may optionally have a bulbous tip 110 mounted on the end of the leg portion 101A. By blunting the end of the leg, which contacts the underside of the seat, tip 110 provides a means for protecting the seat from being scratched or otherwise damaged by the end of the seat-raising leg 101A. Tip 110 is optimally an ellipsoidal mass of plastic resin which is permanently mounted on the end of leg 101A. Shank portion 101C is optimally a substantially rectilinear section of spring 101 extending tangentially from the other end of torsion coil 101B. Shank 101C serves as a bracing means for the spring and has a surface for contacting a backstop, as discussed below.

Figure 1A:
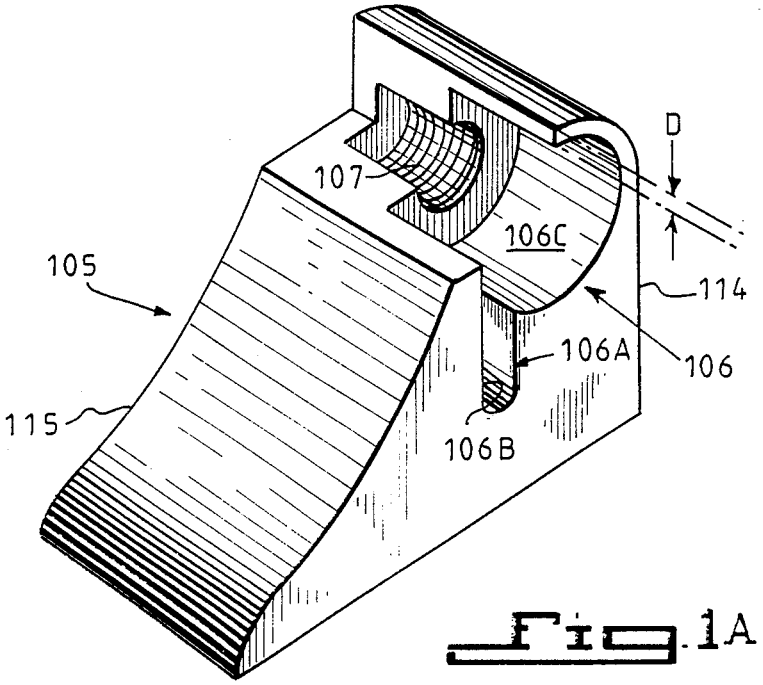
FIG. 1A illustrates a cut-away perspective view of the seat mounting member.

Seat mounting member 105 is preferably constructed from metal, or polymeric resin (e.g. injection molded thermoplastic resin), and has a substantially flat base 113 for contacting the surface of a toilet bowl and one or more tapped holes 108A and 108B for receiving a mounting bolt. The choice of which tapped hole 108A or 108B is to be used will depend on the model of toilet seat. As shown in FIGS. 1 and 1A, seat mounting member 105 has a substantially perpendicular front face 114 and optionally has a relatively gentle slope 115 on the rearward side.

Notch 106 in the side of seat mounting member 105 is adapted to receive the spring 101. More particularly, the notch 106 has a round portion 106C for receiving the torsion coil portion 101B, and a linear portion 106A extending tangentially from the round portion 106C. The linear portion 106A is adapted to receive the shank 101C of the spring 101, and has a surface 106B which acts as a backstop to the shank portion 101C when said shank abuts against the backstop surface 106B.

Notch 106 additionally has a tapped hole 107 which serves as a means to retain the threaded end 102A of horizontally extending hinge pin 102. Tapped hole 107 is located concentrically within the round portion 106C of notch 106. Hinge pin 102 is coaxially disposed within the center of helical coil 101B, and removably mounted by screwing into tapped hole 107.

One end of hinge pin 102 is retained in the seat mounting member, and the second end of hinge pin 102 is retained in the toilet seat. (See FIG. 2) Although in the embodiment illustrated herein threaded end 102A of hinge pin 102 is fixedly retained by the seat mounting member and the second end is pivotally retained by the toilet seat 202, it is also within the scope of the present invention for the second end of the hinge pin 102 to be fixedly retained by the toilet seat and the first end to be pivotally retained by the seat mounting member, or to have both ends of the hinge pin pivotally retained. Regarding such embodiments, the pivotally retained ends need not be threaded.

Threaded mounting bolt 103 provides a means for mounting the seat mounting member 105 on a toilet bowl and is adapted to be removably screwed into a cavity such as a tapped hole 108A or 108B located in the base 113 of the seat mounting portion 105 so as to depend vertically from the seat mounting portion 105. As used herein, the term "toilet bowl" refers to conventional toilet bowls, commodes, and other such sanitary facilities. The choice of which tapped hole 108A or 108B is to be used will depend on the make or model of toilet seat. When in use, mounting bolt 103 will be disposed through a hole in the mounting surface of the toilet bowl, and washer 109 and nut 104 will be used to secure the invention to the bowl.

Figure 1B:
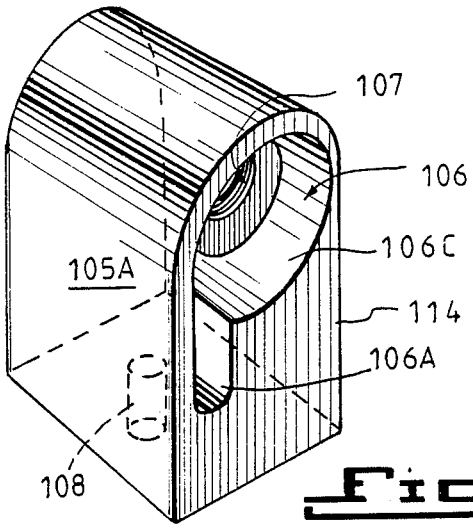
FIG. 1B illustrates an alternative embodiment of the seat mounting member.
Figure 10:
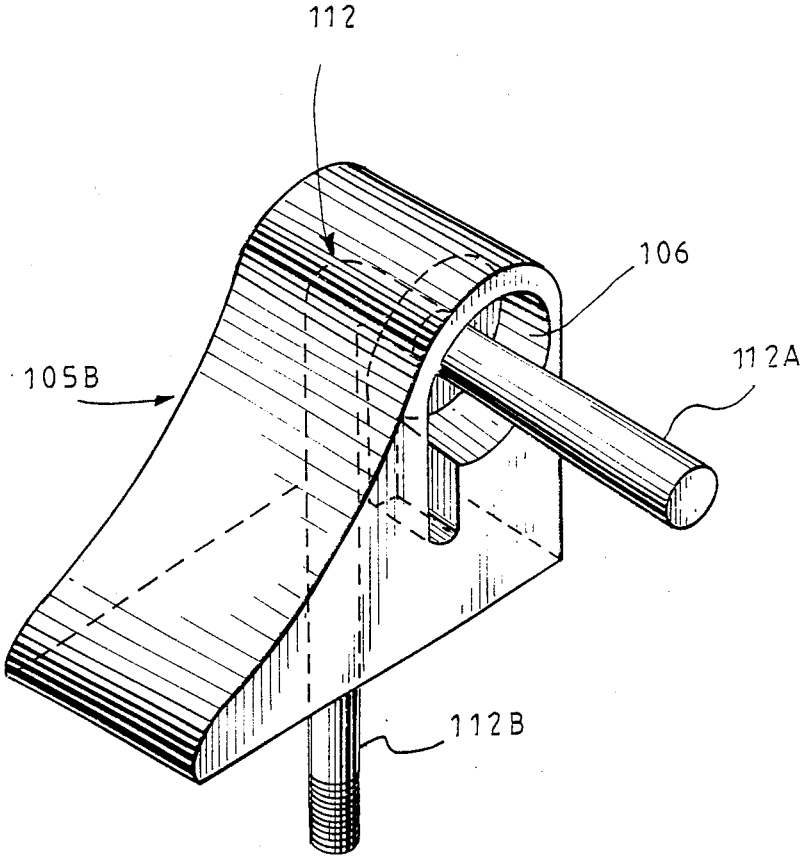

FIG. 1B illustrates an alternative embodiment of the seat mounting portion 105A which does not have a gently sloping rear side, but rather a vertical wall. This type of seat mounting portion 105A has hole 108 for receiving a mounting bolt 103.

FIG. 1C illustrates an alternative embodiment of the invention having a hinge post 112 contained in the seat mounting member 105B. For example, the seat mounting member 105B may be made of polymeric material which is injection molded, or otherwise molded, around hinge post 112. Hinge post 112 has a hinge pin portion 112A which extends horizontally from the seat mounting member 105B so as to be coaxially disposed through the torsion coil 101B of the spring and which pivotally connects to a toilet seat hinge. As shown in FIG. 1C, the hinge post 112 is a single piece which may be configured so that it has an integral depending mounting bolt portion 112B which projects vertically from the base of the seat mounting member 105B.

Figure 2:
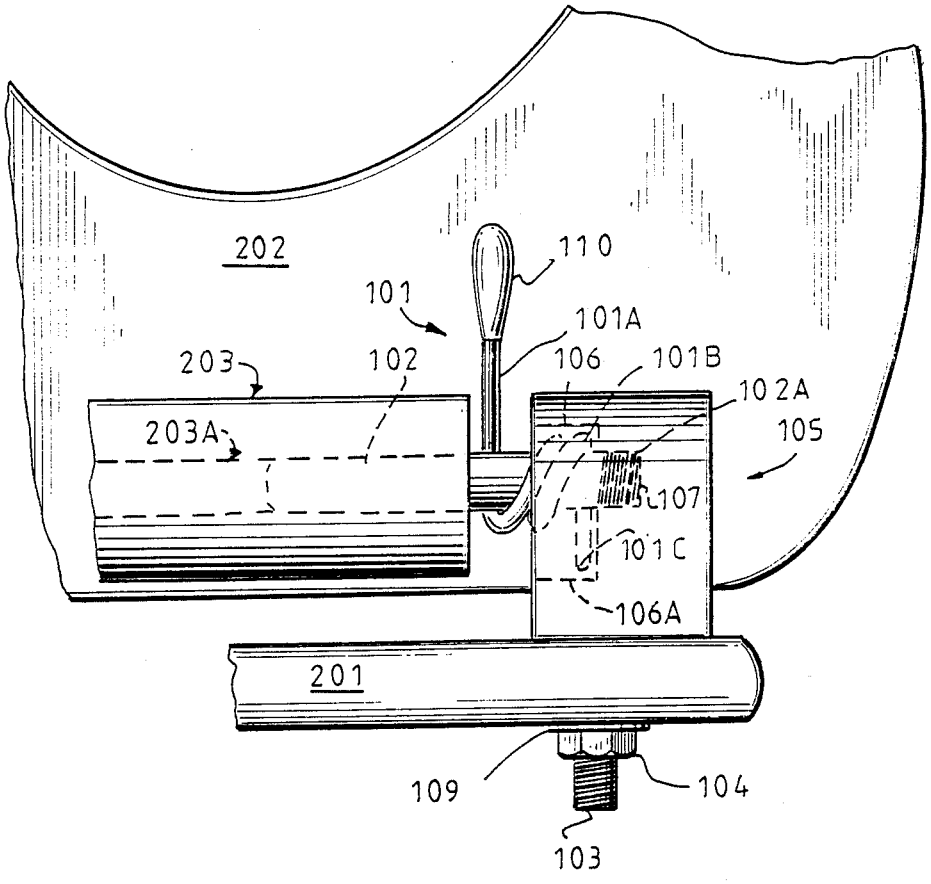
FIG. 2 illustrates a front view of the invention being used in conjunction with a toilet bowl and toilet seat; and, FIG. 3 illustrates a perspective view of the invention used in conjunction with a toilet bowl having a pivotally mounted seat.

The mounting arrangement is shown more clearly in FIG. 2. Toilet seat 202 has a projecting barrel joint 203 in which there is a cylindrical channel 203A for inserting hinge pin 102 around which the seat 202 will pivot. Torsion coil 101B is mounted helically around hinge pin 102, and seat-raising leg portion 101A of spring 101 extends tangentially from coil 101B thereby contacting seat 202 and biasing the seat in an upward position. The ellipsoidal tip 110 at the end of spring 101 prevents the seat from being scratched, gouged, marred or otherwise damaged by the metal spring. The seat mounting member 105 is bolted to the mounting surface of the toilet bowl 201 by means of mounting bolt 103, washer 109, and nut 104.

A force must be exerted by the user to pull the seat from the raised to the lowered position. Such a force will cause torque energy to be stored in the torsion coil 101B. The shank portion 101C of the spring 101 is thereby biased into close abutment against the backstop surface 106A. The resistance force of the backstop surface 106B is distributed substantially over the whole length of shank portion 101C along the contiguous surface of said shank, thus preventing a concentration of force in any one point which might cause the spring to break or wear out rapidly. The spring can be made of sufficient strength such that when force is removed from the toilet seat, the spring will raise the seat from a lowered to an upright position.

Preferably, the spring 101 will be made of a resilient strong material such as stainless steel. The hinge pin 102 also is preferably made of stainless steel. The seat mounting member 105 can be made of anodized aluminum or polymeric resin which is, for example, injection molded. Washer 109 and nut 104 are conventional and may be made of stainless steel. Mounting bolt 103 is also conventional and can be made of steel, iron, or other suitable material. The tip 110 may be made of plastic, or any other material suitable for preventing the underside of toilet seat 202 from being scratched by the end of leg 101A, and is preferably adhesively bonded to said tip.

The invention may be incorporated into new toilet seats, or it may also be retrofitted onto existing toilet facilities. Retrofitting is easy because only one fitting need be removed and replaced. The dimensions of the spring hinge 100 can be standardized so as to fit the conventional toilet seats in use today. For example, the vertical distance from the base of the seat mounting member 105 to the centerpoint of the hinge pin mounting hole 107 is ideally about 1.09 inches, and from the base of the seat mounting member 105 to the top, the vertical distance is ideally about 1.5 inches. The diameter of the round portion 106C of the notch is ideally about 0.69 inches, and the vertical distance between the centerpoint of the hinge pin mounting hole 107 and the lower extremity of the tangential linear portion 106B of the notch is ideally about 0.59 inches. The horizontal distance between the front face 114 of the seat mounting member 105 and the center point of the hinge pin mounting hole 107 is ideally about 0.41 inches as is the horizontal distance between the front face 114 of the seat mounting member 105 and the centerpoint of tapped hole 108B. The distance between the top of the seat mounting member 105 to the top of the round portion 106C of the notch is ideally about 0.06 inches, see distance "D" in FIG. 1A.

Alternatively two spring hinge assemblies may be used in conjunction: one on each side of the toilet seat hinge. In such a situation, the spring hinges must include a left oriented one used in conjunction with a right oriented one.

Figure 3:
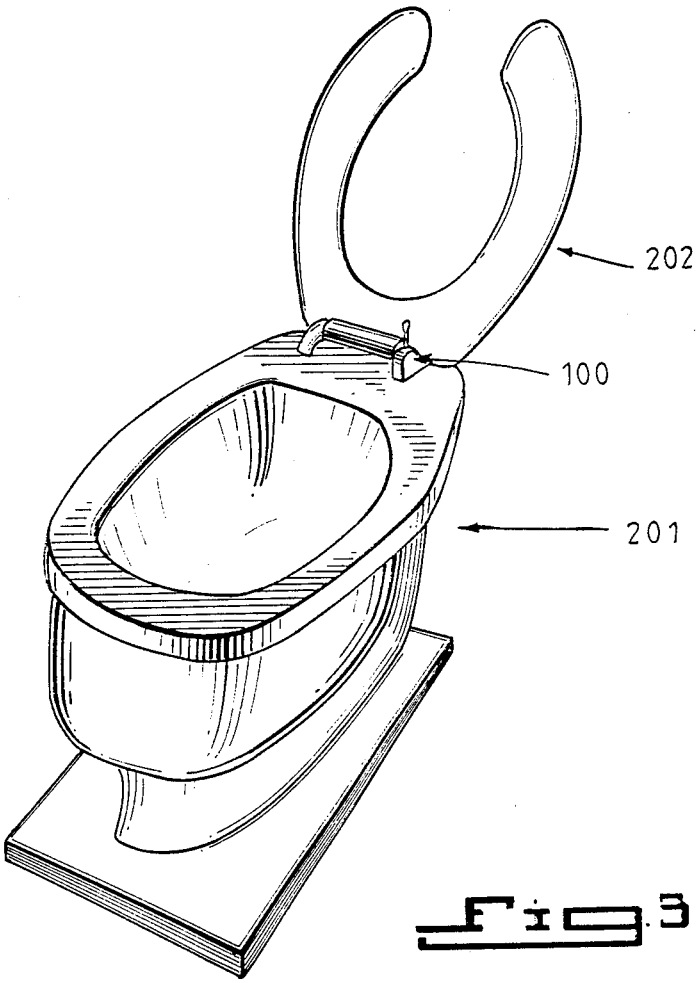

FIG. 3 illustrates a perspective view of the spring hinge assembly 100 used in conjunction with a toilet bowl 201 having a pivotally mounted toilet seat 202.

While the above description contains many specifics, these specifics should not be construed as limitations of the invention, but merely as exemplifications of embodiments thereof. Those skilled in the art will envision many other variations which are within the scope and spirit of the present invention as defined by the appended claims.

What is claimed is:

1. A hinge assembly for a toilet seat, said hinge assembly comprising:

(a) a spring of integral, single piece construction, said spring comprising a torsion coil portion, a linear seat-raising portion leg extending tangentially from said helical torsion coil portion, and a linear bracing means portion extending tangentially from said helical torsion coil portion;

(b) a seat mounting member comprising (i) a notch comprising a substantially round portion for receiving said helical torsion coil portion of said spring, and a linear portion extending tangentially from said round portion for receiving said linear bracing means portion of said spring and for providing a backstop for said linear bracing means portion;

(ii) means for retaining a horizontally extending hinge pin, said means for retaining being located concentrically within said round portion of said notch; and (iii) means for mounting said seat mounting member to a toilet bowl; and, (c) a hinge pin for pivotally connecting a toilet seat to said seat mounting member, said hinge pin being coaxially receivable through said helical torsion coil, and said hinge pin having a first end for being retained by said seat mounting member and a second end for being retained by said toilet seat.

2. The hinge assembly of claim 1 wherein said linear bracing means comprises a rectilinear shank portion having a surface for contacting the backstop.

3. The hinge assembly of claim 1 wherein the hinge pin is fixedly retained by said seat mounting member.

4. The hinge assembly of claim 1 wherein the means for retaining said horizontally extending hinge pin in the seat mounting member comprises a hole adapted to receive said first end of the hinge pin.

5. The hinge assembly of claim 1 wherein said means for mounting the seat mounting member on a toilet bowl comprises at least one hole adapted to receive a vertically depending mounting bolt.

6. The hinge assembly of claim 5 wherein the mounting bolt is fixedly retained by the seat mounting member.

7. The hinge assembly of claim 1 further comprising means on the linear seat-raising leg portion of the spring to prevent the seat from being damaged when contacted by said linear seat raising leg portion.

8. The hinge assembly of claim 7 wherein the means to prevent the seat from being damaged comprises a bulbous tip mounted to the end of said linear seat raising leg portion.

9. A hinge assembly for a toilet seat, said hinge assembly comprising:

(a) a spring of integral, single piece construction, said spring comprising a torsion coil portion, a linear seat-raising leg portion extending tangentially from said helical torsion coil portion, and a linear bracing means portion extending tangentially from said helical torsion coil portion;

(b) a seat mounting member comprising (i) a notch comprising a substantially round portion for receiving said helical torsion coil portion of said spring, and a linear portion extending tangentially from said round portion for receiving said linear bracing means portion of said spring and for providing a backstop for said linear bracing means portion;

(ii) a hinge post contained in the seat mounting member, said hinge post having a hinge pin portion extending substantially horizontally from said seat mounting member for disposition through said helical torsion coil portion and for pivotal connection to the toilet seat, and a mounting bolt portion extending substantially vertically from the base of the seat mounting member for mounting said seat mounting member to a toilet bowl.

10. The hinge assembly of claim 9 wherein said linear bracing means portion comprises a rectilinear shank portion having a surface for contacting the backstop.

11. The hinge assembly of claim 9 further comprising means on the linear seat-raising leg portion of the spring to prevent the seat from being damaged when contacted by said linear seat raising leg portion.

12. The hinge assembly of claim 11 wherein the means to prevent the seat from being damaged comprises a bulbous tip mounted to the end of said linear seat raising leg portion.

13. In combination with a toilet seat, a hinge assembly comprising, (a) a spring of integral, single piece construction, said spring comprising a helical torsion coil portion, a linear seat-raising leg extending tangentially from said helical torsion coil portion, and a linear bracing means portion extending tangentially from said helical torsion coil portion;

(b) a seat mounting member comprising (i) a notch comprising a substantially round portion for receiving said helical torsion coil portion of said spring, and a linear portion extending tangentially from said round portion for receiving said linear bracing means portion of said spring and for providing a backstop for said linear bracing means portion;

(ii) means for retaining a horizontally extending hinge pin, said means for retaining being located concentrically within said round portion of said notch; and (iii) means for mounting said seat mounting member to the toilet bowl; and, (c) a hinge pin for pivotally connecting a toilet seat to said seat mounting member, said hinge pin being coaxially receivable through said helical torsion coil, and said hinge pin having a first end for being retained by said seat mounting member and a second end for being retained by said toilet seat.

14. The combination, of claim 13 wherein the hinge pin is fixedly retained by the seat mounting member.

15. The combination of claim 13 wherein said linear bracing means portion comprises a rectilinear shank portion having a surface for contacting a backstop.

16. The combination of claim .13 wherein the means for retaining said horizontally extending hinge pin comprises a hole adapted to receive said first end of the hinge pin.

17. The combination of claim 13 wherein said means for mounting said seat mounting member to the toilet bowl comprises at least one hole adapted to receive a vertically depending mounting bolt.

18. The combination of claim 17 wherein the mounting bolt is fixedly retained by the seat mounting member.

19. The combination of claim 13 further comprising means on the linear seat-raising leg of the spring to prevent the seat from being damaged when contacted by said linear seat raising leg portion.

20. The combination of claim 19 wherein the means to prevent the seat from being damaged comprises a bulbous tip mounted to the end of said linear seat raising leg portion.

21. The combination of claim 13 wherein the toilet seat is pivotally mounted on a toilet bowl.

22. The combination of claim 21 wherein the hinge pin is fixedly retained by the seat mounting member.

23. The combination of claim 21 wherein said linear bracing means portion comprises a rectilinear shank portion having a surface for contacting a backstop.

24. The combination of claim 21 wherein the means for retaining said horizontally extending hinge pin in the seat mounting member comprises a hole adapted to receive said first end of the hinge pin.

25. The combination of claim 21 wherein said means for mounting said seat mounting member to the toilet bowl comprises at least one hole adapted to receive a vertically depending threaded mounting bolt.

26. The combination of claim 25, wherein the mounting bolt is fixedly retained by the seat mounting member.

27. The combination of claim 21, further comprising means on the linear seat-raising leg of the spring to prevent the seat from being damaged when contacted by said linear seat raising leg portion.

28. The combination of claim 27 wherein the means to prevent the seat from being damaged comprises a bulbous tip mounted to the end of said linear seat raising portion.

29. In combination with a toilet seat, a hinge assembly comprising:

(a) a spring of integral, single piece construction, said spring comprising a torsion coil portion, a linear seat-raising leg portion extending tangentially from said helical torsion coil portion, and a linear bracing means portion extending tangentially from said helical torsion coil portion;

(b) a seat mounting member comprising (i) a notch comprising a substantially round portion for receiving said helical torsion coil portion of said spring, and a linear portion extending tangentially from said round portion for receiving said linear bracing means portion of said spring and for providing a backstop for said linear bracing means portion;

(ii) a hinge post contained in the seat mounting member, said hinge post having a hinge pin portion extending substantially horizontally from said seat mounting member, for disposition through said helical torsion coil portion and for pivotal connection to the toilet seat, and a mounting bolt portion extending substantially vertically from the base of the seat mounting member for mounting said seat mounting member to a toilet bowl.

30. The combination of claim 29 wherein said linear bracing means portion comprises a rectilinear shank portion having a surface for contacting a backstop.

31. The combination of claim 29 further comprising means on the linear seat-raising leg portion of the spring to prevent the seat from being damaged when contacted by said linear seat raising leg portion.

32. The combination of claim 31 wherein the means to prevent the seat from being damaged comprises a bulbous tip mounted to the end of said linear seat raising leg portion.

33. The combination of claim 29 wherein the toilet seat is pivotally mounted on a toilet bowl.

34. The combination of claim 33 wherein said linear bracing means portion comprises a rectilinear shank portion.

35. The combination of claim 33 further comprising means on the seat-raising leg portion of the spring to prevent the seat from being damaged when contacted by said seat-raising leg portion.

36. The combination of claim 35 wherein the means to prevent the seat from being damaged comprises a bulbous tip mounted to the end of said linear seat-raising leg portion.

* * * * *